US011488516B2

(12) United States Patent
Cheng et al.

(10) Patent No.: US 11,488,516 B2
(45) Date of Patent: Nov. 1, 2022

(54) CIRCUIT, METHOD OF DRIVING PANEL, AND DISPLAY DEVICE

(71) Applicants: BEIHAI HKC OPTOELECTRONICS TECHNOLOGY CO., LTD., Beihai (CN); HKC CORPORATION LIMITED, Shenzhen (CN)

(72) Inventors: Chiayang Cheng, Beihai (CN); Chongwei Tang, Beihai (CN)

(73) Assignees: BEIHAI HKC OPTOELECTRONICS TECHNOLOGY CO., LTD., Beihai (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/160,797

(22) Filed: Jan. 28, 2021

(65) Prior Publication Data

US 2022/0036796 A1 Feb. 3, 2022

(30) Foreign Application Priority Data

Jul. 28, 2020 (CN) ..... 202010740590.7

(51) Int. Cl.
*G09G 3/20* (2006.01)

(52) U.S. Cl.
CPC ... *G09G 3/2092* (2013.01); *G09G 2310/0267* (2013.01); *G09G 2310/0286* (2013.01)

(58) Field of Classification Search
CPC ..... G09G 3/2092; G09G 2310/0267; G09G 2310/0286
See application file for complete search history.

(56) References Cited

U.S. PATENT DOCUMENTS 9,928,799 B2 * 3/2018 Lee ..... G09G 3/3688
2011/0148830 A1 * 6/2011 Hsu ..... G09G 3/3266 345/205

(Continued)

FOREIGN PATENT DOCUMENTS

CN 1889166 A 1/2007
CN 101894515 A 11/2010

(Continued)

OTHER PUBLICATIONS

First Office Action issued in counterpart Chinese Patent Application No. 202010740590.7, dated Jul. 28, 2021.

(Continued)

*Primary Examiner* — Ibrahim A Khan
(74) *Attorney, Agent, or Firm* — Westbridge IP LLC

(57) ABSTRACT

Provided are a circuit, a method of driving the panel, and a display device. The driving circuit includes a plurality of scanning lines, a plurality of clock signal connecting lines, a time controller and a multiple shift register unit. The input end of the shift register unit is correspondingly connected to the other end of the clock signal connecting line to receive clock signals of the time controller, and the output ends of the shift register units are connected with the scanning lines in one-to-one correspondence; Starting from the first shift register unit, the adjacent two shift register units are taken as a shift register group, and the clock signals sent by the time controller to the two shift register units in the same group via the clock signal connecting line have the same waveform.

6 Claims, 5 Drawing Sheets

(56) References Cited

U.S. PATENT DOCUMENTS

| | | | | |
|---|---|---|---|---|
| 2012/0032941 | A1* | 2/2012 | Chen | G09G 3/3677 345/212 |
| 2013/0033468 | A1 | 2/2013 | Takahashi | |
| 2013/0222357 | A1* | 8/2013 | Tseng | G09G 3/20 345/212 |
| 2014/0198023 | A1* | 7/2014 | Hsu | G09G 3/3674 345/99 |
| 2015/0339999 | A1* | 11/2015 | Zheng | G11C 19/28 377/64 |
| 2018/0166036 | A1 | 6/2018 | Li et al. | |
| 2019/0043412 | A1 | 2/2019 | Yang et al. | |
| 2019/0333433 | A1 | 10/2019 | Zhu et al. | |
| 2021/0027734 | A1* | 1/2021 | Shan | G11C 19/28 |

FOREIGN PATENT DOCUMENTS

| | | | | | |
|---|---|---|---|---|---|
| CN | 102610185 | A | | 7/2012 | |
| CN | 102819998 | A | | 12/2012 | |
| CN | 105161042 | A | | 12/2015 | |
| CN | 105161066 | A | | 12/2015 | |
| CN | 105161134 | A | | 12/2015 | |
| CN | 108230981 | A | | 6/2018 | |
| CN | 108428469 | A | | 8/2018 | |
| CN | 109559706 | A | * | 4/2019 | G09G 3/3677 |
| CN | 109559706 | A | | 4/2019 | |
| CN | 110264937 | A | | 9/2019 | |

OTHER PUBLICATIONS

Second Office Action issued in counterpart Chinese Patent Application No. 202010740590.7, dated Nov. 10, 2021.

* cited by examiner

CIRCUIT, METHOD OF DRIVING PANEL, AND DISPLAY DEVICE

CROSS REFERENCE TO RELATED APPLICATIONS

The present application claims the priority of Chinese Patent Application filed in the National Intellectual Property Administration on Jul. 28, 2020, with the application number 202010740590.7 and Title "Circuit, method of driving panel, and display device", the entire contents of which are hereby incorporated by reference.

TECHNICAL FIELD

The disclosure relates to the technical field of driving panels, in particular to a circuit, a method of driving panel, and a display device.

BACKGROUND

The statements herein merely provide background information related to the present application and do not necessarily constitute prior art.

Gate Driver On Array (GOA) technology is a technology that uses the existing thin film transistor liquid crystal display Array (array) process and make the gate row scanning drive signal circuit on the array substrate to drive the scanning of the gate in rows.

However, signal delay is large with regards to the scanning signal output by the GOA circuit, which increases the time for driving the gate to scanning line by line, resulting in an increase in panel resolution.

SUMMARY

The present disclosure is to provide a circuit, a method of driving a panel, and a display device. The scanning signal output by the GOA circuit having a large signal delay, and the time cost for driving the gate to scanning line by line and the increase in resolution of the panel would be prevented.

For above, an embodiment of the present disclosure provides a circuit of driving the panel, which includes:

a plurality of scanning lines;

a plurality of clock signal connecting lines;

a time controller connected with ends of the clock signal connecting lines, and multiple shift register units arranged in cascade, wherein input ends of the shift register units are correspondingly connected to other ends of the clock signal connecting lines to receive clock signals sent by the time controller, and output ends of the shift register units are connected with the scanning lines in one-to-one correspondence;

wherein, starting from a first shift register unit, two adjacent shift register units are taken as a shift register group, and waveforms of the clock signals sent by the time controller to the two adjacent shift register units are equal via the clock signal connecting lines in a same shift register group.

In one embodiment, a wave of a clock signal received by a first shift register group is earlier than a wave of a clock signal received by a second shift register group just following the first shift register group by one periodic time.

In one embodiment, the shift register unit comprises a first switch tube, a second switch tube, a third switch tube and a fourth switch tube, a gate end of the first switch tube is connected with a source end of the first switch tube to form an input end of a frame start signal, and a drain end of the first switch tube is connected with a gate end of the third switch tube and a source end of the second switch tube, respectively, a drain end of the third switch tube is connected with a gate end of the fourth switch tube, a drain end of the second switch tube is connected with a drain end of the fourth switch tube to form an input end of a low voltage of DC, a source end of the third switch tube is connected with the clock signal connecting lines.

In which an output end for an output signal is formed between the drain of the third switch tube and the source of the fourth switch tube.

In one embodiment, the waveforms of the frame start signals input from input terminals of the frame start signals are equal of the two shift register units in the shift register group.

In one embodiment, the waveforms of the frame start signals input from input terminals of the frame start signals are equal of the two shift register units in the shift register group.

In one embodiment, the shift register unit comprises a capacitor, wherein one end of the capacitor is connected between the drain end of the first switch tube and the gate end of the third switch tube, and an other end of the capacitor is connected to the drain end of the third switch tube and the source end of the fourth switch tube.

In order to achieve the aforementioned objective, an embodiment of the present disclosure also provides a method of driving the panel, which is applied to the above circuit, including:

controlling a time controller to provide clock signals to multiple shift register units, in which starting from a first shift register unit, two adjacent shift register units are taken as a shift register group, and waveforms of the clock signals received by the two adjacent shift register units in a same shift register group are equal; and controlling the shift register unit to convert the clock signals into output signals and transmit the output signals to scanning lines.

In one embodiment, the method of driving the panel further includes:

controlling the time controller to provide a frame start signal to the first shift register unit and the second shift register unit.

In one embodiment, except for the first and second shift register units, a frame start signal of an odd-numbered shift register unit is an output signal of a previous odd-numbered shift register unit, and a frame start signal of an even-numbered shift register unit is an output signal of a previous even-numbered shift register unit.

In order to achieve the above objective, another aspect of the present disclosure also provides a display device, which includes an array substrate, an opposite substrate arranged opposite to the array substrate, and a liquid crystal cell layer arranged between the array substrate and the opposite substrate.

The array substrate includes the circuit.

A circuit, a method of driving a panel and a display device are provided. The circuit includes a plurality of scanning lines, a plurality of clock signal connecting lines, a time controller and multiple shift register units in cascade. The input ends of the shift register units are correspondingly connected to the other end of the clock signal connecting lines to receive clock signals of the time controller, and the output ends of the shift register units are connected with the scanning lines in one-to-one correspondence. Starting from the first shift register unit, the adjacent two shift register units are taken as a shift register group, and the clock signals sent by the time controller to the two shift register units in the same group via the clock signal connecting lines have the same waveform. As such, two scanning lines can be driven simultaneously by a same clock signal, speeding up the charging of the panel and reducing the resolution.

BRIEF DESCRIPTION OF THE DRAWINGS

In order to explain the embodiments of the present application or the technical solutions in the prior art more clearly, the drawings used in the embodiments or the description of the prior art will be briefly introduced below. Obviously, the drawings in the following description are only some embodiments of the present application. For those skilled in the art, some other drawings can be obtained according to the structures shown in these drawings without paying creative effort.

Figure 1:
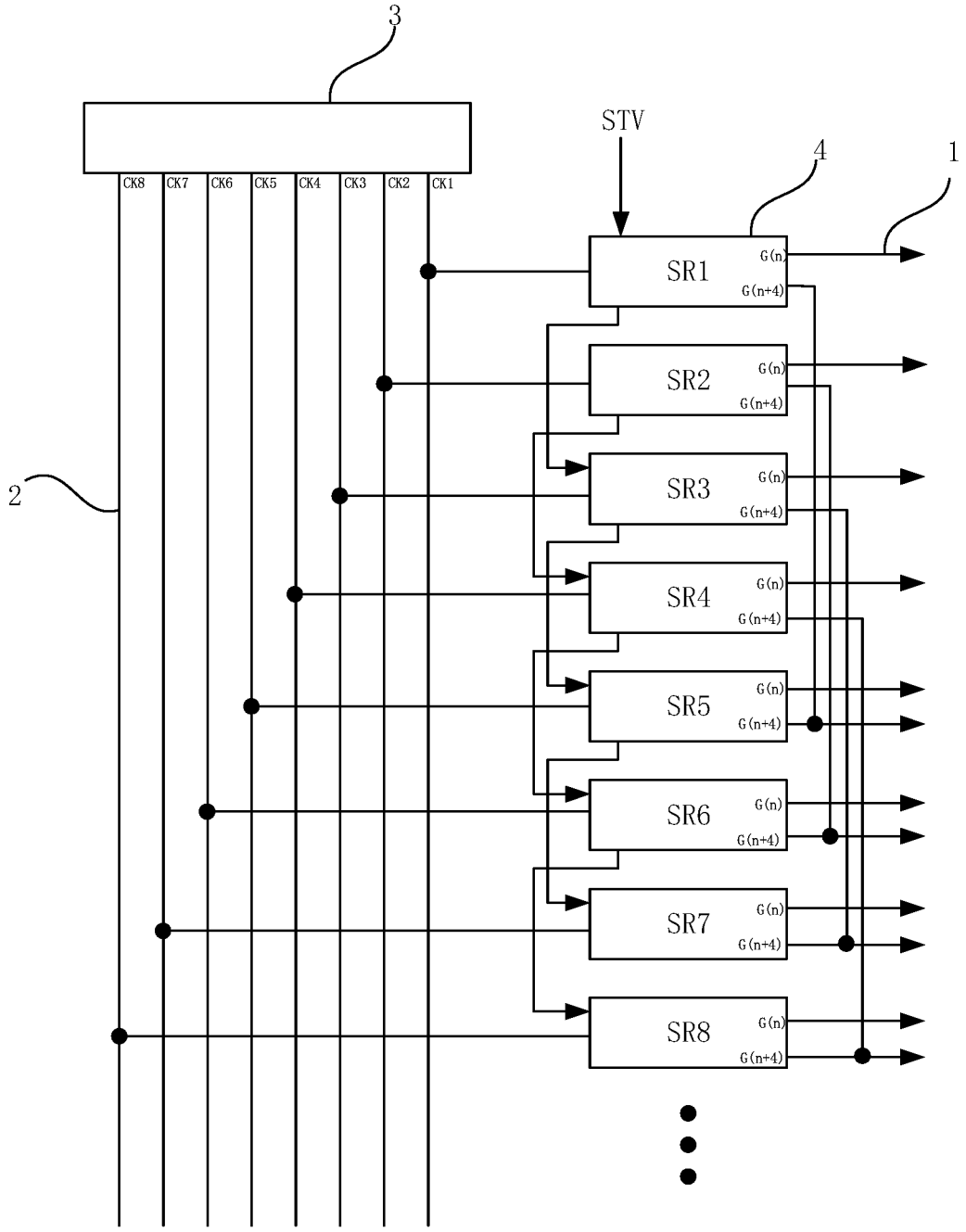
FIG. 1 is a schematic diagram showing component connection of a circuit according to an embodiment of the present disclosure.

The implementation, functional features and advantages of the present application will be further described with reference to the accompanying drawings with the embodiments.

DETAILED DESCRIPTION OF THE EMBODIMENTS

As following, the technical solution in the embodiments of the present disclosure will be described clearly and completely with reference to the drawings in the embodiment of the present application. Obviously, the described embodiment is only a part of the embodiment of the present application, not all of the embodiments. Based on the embodiments in the present application, all other embodiments perceived by those ordinary skills in the art without creative effort should be fallen within the protection scope of the present application.

It should be noted that all directional indicators (such as upper, lower, left, right, front, rear, etc.) in the embodiment of the present application are only used to explain the relative positional relationship, movement, etc. between various components under a certain specific posture (as shown in the drawings). If the specific posture changes, the directional indicator will also change accordingly.

In addition, the descriptions related to "first", "second" and the like in the present application are for descriptive purposes only and cannot be understood as indicating or implying its relative importance or implicitly indicating a number of technical features indicated. Thus, features defining "first" and "second" may explicitly or implicitly include at least one of the features. In addition, the technical solutions between the various embodiments may be combined with each other, but must be based on what one of ordinary skill in the art can achieve. When the combination of technical solutions is contradictory or impossible to achieve, it should be considered that the combination of such technical solutions does not exist and is not within the protection scope required by the present application.

Figure 2:
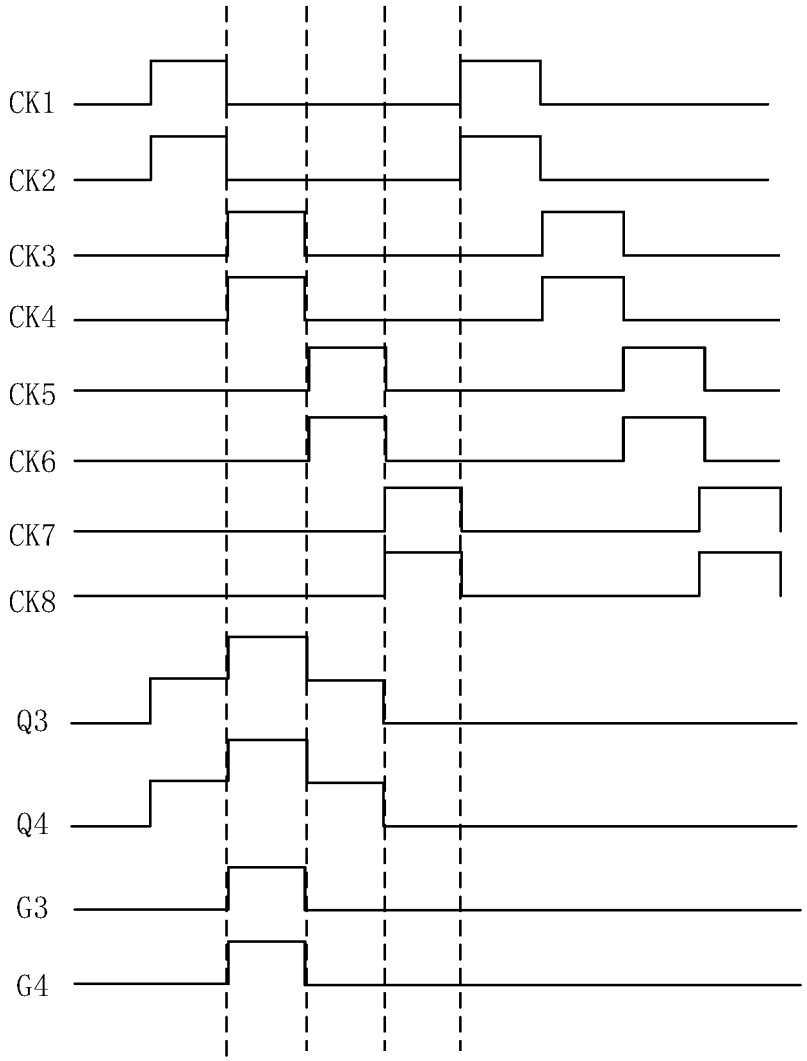
FIG. 2 is a schematic diagram of a waveform of a signal according to an embodiment of the present disclosure.
Figure 3:
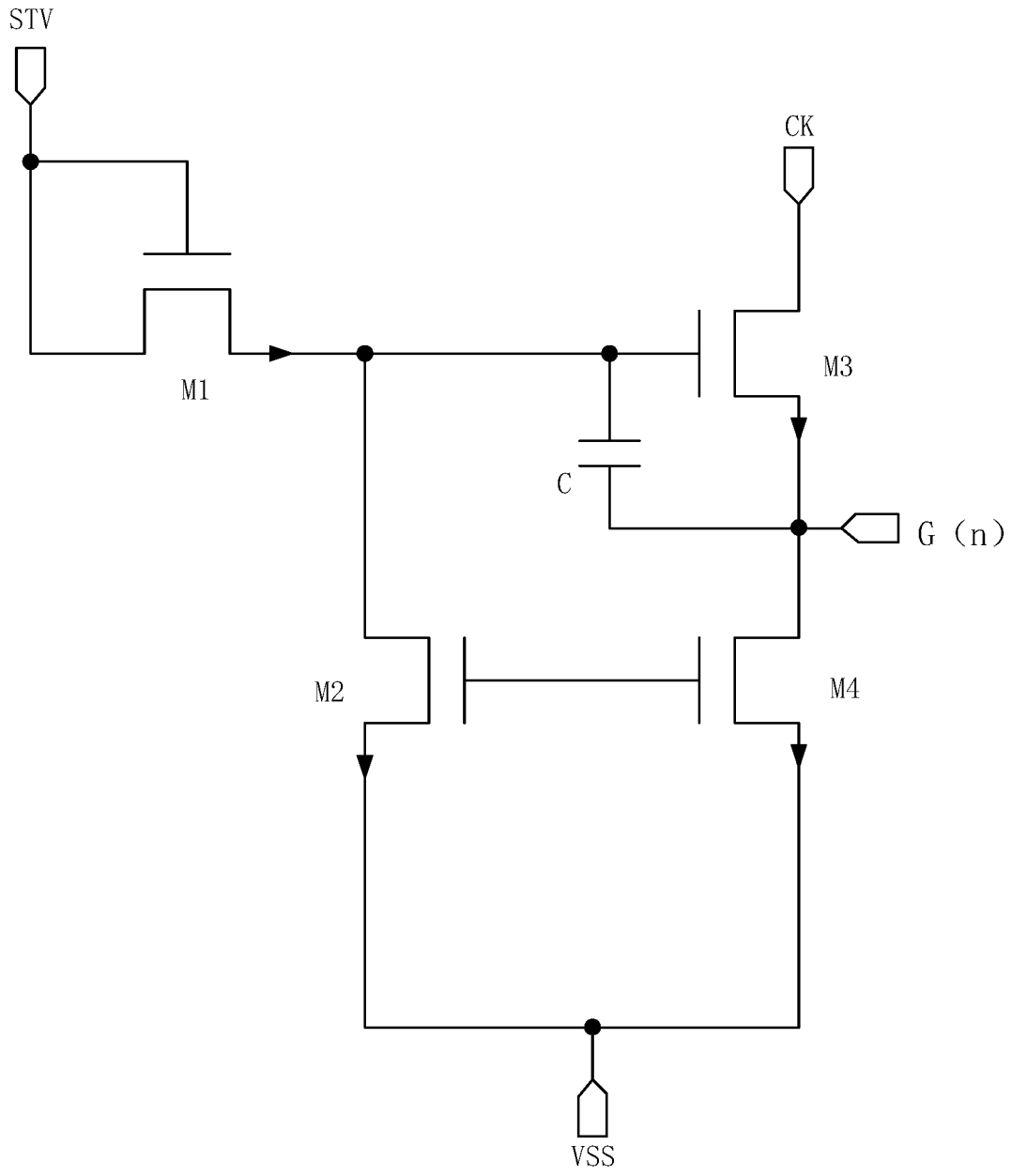
FIG. 3 is a diagram showing connections regarding a shift register unit according to an embodiment of the present disclosure.

As shown in FIGS. 1 to 3, an embodiment of the present disclosure provides a circuit of driving a panel.

In the embodiment, as shown in FIG. 1, the circuit includes a plurality of scanning lines 1, a plurality of clock signal connecting lines 2, a time controller 3 and multiple shift register units 4 in cascade. The time controller 3 is connected to ends of the clock signal connecting line 2, and the input ends of the shift register units 4 are correspondingly connected to the other ends of the clock signal connecting line 2 to receive the clock signals of the time controller 3. The output ends of the shift register units are connected with the scanning lines 1 in one-to-one correspondence.

Further, the time controller 3 is provided with a plurality of connecting ports, and the clock signal connection lines 2 are connected with the time controller 3 through the connecting ports. The time controller 3 correspondingly inputs clock signals CK1 to CKN to the clock signal connection lines 2, where n is the number of clock signal connection lines 2. In one embodiment, n is any even number ranging from 2 to 12. In the present embodiment, n is 8. That is, the time controller 3 can provide eight clock signals for the multiple shift register units 4.

It can be understood that in some other embodiments, n can also be 4. The time controller 3 can provide four clock signals for the multiple shift register units 4. The number of n is not limited herein.

Further, the number of the shift register units 4 is equal to the number of scanning lines 1. For example, the resolution of the panel is 1920*1080, the number of scanning lines 1 in the panel is 1080. As such, there have 1080 shift register units 4. And the output ends of the shift register units 4 are connected with scanning lines 1 correspondingly. And the output signals of the output ends of the shift register units 4 can be sent to the scanning lines 1 and drive the scanning lines 1.

Further, starting from a first shift register unit, two adjacent shift register units 4 are taken as a shift register group, and waveforms of the clock signals sent by the time controller 3 to the two adjacent shift register units 4 are equal via the clock signal connecting lines in a same shift register group. For example, the first shift register unit 4 and the second shift register unit 4 are taken as the first shift register group, and the third-stage shift register unit 4 and the fourth-stage shift register unit 4 are taken as the second shift register group, and so on, the last two shift register units 4 are taken as the last shift register group. When the time controller 3 sends the clock signals to the two shift register units 4 in a same group via the clock signal connection line 2, the waveforms of the clock signals of the two shift register units 4 in the same group are equal.

Furthermore, as shown in FIG. 2, the time controller 3 simultaneously inputs clock signals having the same waveform into the first shift register unit 4 and the second shift register unit 4. The first shift register unit 4 and the second shift register unit 4 convert the clock signals into output signals, and transmit the output signals to drive the two scanning lines 1 connected correspondingly.

Furthermore, suppose there have 8 clock signals, which are CK1 to CK8 having the same waveform provided by the time controller 3. That is, CK1 and CK2 are clock signals with the same waveform. CK3 and CK4 are clock signals with the same waveform, CK5 and CK6 are clock signals with the same waveform, and CK7 and CK8 are clock signals with the same waveform. When the clock signal drives the panel, one clock signal can drive two scanning lines 1 simultaneously, reducing the charging time for the panel. The panel includes red, green and blue pixels. Taking charging red pixels as an example, if the clock signals CK1 and CK2 are clock signals with different waveforms, the clock signal CK1 can only drive the corresponding shift register unit 4 and scanning line 1. One clock signal may merely charge the red pixel corresponding to one scanning line 1. And if the clock signals CK1 and CK2 are clock signals with a same waveform, the clock signals CK1 and CK2 can drive the corresponding two shift register units 4 and their corresponding scanning lines 1. A same clock signal (CK1 and CK2) can charge the red pixels corresponding to the two scanning lines 1. As such, two scanning lines 1 can be driven simultaneously by a same clock signal, speeding up the charging of the panel and reducing the resolution.

In the present embodiment, the circuit includes a plurality of scanning lines 1, a plurality of clock signal connecting lines 2, a time controller 3 and multiple shift register units 4 in cascade. The input ends of the shift register unit 4 are correspondingly connected to the other ends of the clock signal connecting lines 2 to receive clock signals of the time controller 3, and the output ends of the shift register units 4 are connected with the scanning lines 2 in one-to-one correspondence. Starting from the first shift register unit 4, the adjacent two shift register units 4 are taken as a shift register group, and the clock signals sent by the time controller 3 to the two shift register units 4 in the same group via the clock signal connecting lines 2 have the same waveform. As such, two scanning lines 1 can be driven simultaneously by a same clock signal, speeding up the charging of the panel and reducing the resolution.

Furthermore, in order to ensure that the scanning lines 1 of the panel can be driven line by line, the waveform of the clock signal received by every two adjacent shift register groups differs by a time period. For example, the shift registers in the first shift register group are the first shift register and the second shift registers, and the shift registers in the second shift register group are the third shift registers and the fourth shift registers, and so on. The wave of a clock signal received by a shift register group is earlier than a wave of a clock signal received by another shift register group just following the shift register group by one periodic time. The one periodic time is the reciprocal of the multiplication between the number of frames and the number of scanning lines. In one embodiment, when picture has 60 frames and the number of scanning lines 1 is 1080, a time period is 1/(60*1080). However, different panels may have different frame and scanning line in numbers, which is not limited in the present disclosure.

As shown in FIG. 1, there have m shift register units 4, i.e., SR1, SR2, SR3, . . . , SRm, etc. In the figures, the circuits of each shift register units 4 are identical.

Furthermore, as shown in FIG. 3, the shift register unit 4 includes a first switch tube M1, a second switch tube M2, a third switch tube M3 and a fourth switch tube M4. A gate end and a source end of the first switching tube M1 are connected to form an input end of the frame start signal STV; a drain end of the first switching tube M1 is connected with a gate end of the third switching tube M3 and a source end of the fourth switching tube M4, respectively. A drain end of the third switch tube M3 is connected with the source of the fourth switch tube M4. A drain end of the second switch tube M2 is connected with a drain end of the fourth switch tube M4 to form an input end of low voltage VSS of DC. A source end of the third switch tube M3 is connected with the clock signal connecting line 2 to input clock signals CK, which can be selected as eight clock signals CK1-CK8 in the present embodiment. An output end of the output signal G(n) is formed between the drain end of the third switching tube M3 and the source end of the fourth switching tube M4.

Further, the first switch tube M1 is a charging module of the shift register unit 4, the third switch tube M3 is an output module of the shift register unit 4, and the second switch tube M2 and the fourth switch tube M4 are reset modules of the shift register unit 4.

Further, the frame start signal STV is input into the shift register unit 4 from the input terminal of the frame start signal STV. When the shift register units 4 are the first shift register unit 4 and the second shift register unit 4, the frame start signal STV is provided by the time controller 3 to start the first shift register unit 4 and the second shift register unit 4. When the shift register unit 4 is other than the first stage shift register unit 4 and the second stage shift register unit 4, the other shift registers include two types, namely odd-numbered shift register units 4 and even-numbered shift register units 4. The frame start signal for an odd-numbered shift register unit 4 is the output signal of a previous odd-numbered shift register unit just before the odd-numbered shift register. The frame start signal for an even-numbered shift register unit 4 is the output signal of a previous even-numbered shift register unit just before the even-numbered shift register. For example, the frame start signal STV of the fifth shift register unit 4 is the output signal of the third stage shift register unit 4, and the frame start signal STV of the sixth shift register unit 4 is the output signal of the fourth shift register unit 4. That is to say, the output signal of the shift register unit 4 is not only configured to drive the scanning line 1 connected thereto, but also configured as the frame start signal STV of the next corresponding shift register unit 4 for its start.

Furthermore, when the frame start signal STV of the shift register unit 4 is not input to the input end of the frame start signal STV, and the time controller 3 inputs a clock signal to the source end of the third switch tube M3 through the clock signal connection line 2, the gate of the third switch tube M3 is still at a low level, that is, the third switch tube M3 would be in a closed state, the drain end and the source end of the third switch tube M3 would be turned off, so that the output terminal of the output signal outputs a low level. Or, when the frame start signal STV of the shift register unit 4 is input to the input end of the frame start signal STV, and no clock signal is input to the source end of the third switch tube M3, the first switch tube M1 is on, that is, the gate of the third switch tube M3 would be still at a high level. The source end of the third switch tube M3 is at a low level, the drain end and the source end of the third switch tube M3 are still off, so that the output end of the output signal outputs a low level.

Further, when the frame start signal STV of the shift register unit 4 is input to the input end of the frame start signal STV, and the time controller 3 inputs a clock signal to the source end of the third switch tube M3 through the clock signal connection line 2, the first switch tube M1 would be in an "on" state. That is, the gate of the third switch tube M3 is still in a high level. That is, the third switch tube M3 is in an "off" state, and the source end of the third switch tube M3 is at high level, the drain end and the source end of the third switch tube M3 are conducted. The output signal from the output end is at high level.

Furthermore, the second switch tube M2 and the fourth switch tube M4 are used for resetting the shift register unit 4, so that all the shift register units 4 will interact with each other under the clock signal provided by the time controller 3, and generate a shift pulse signal to scan the scanning line 1 line by line.

As shown in FIG. 2, taking eight clock signals as an example, clock signals CK1 and CK2 have the same waveform, clock signals CK3 and CK4 have the same waveform, clock signals CK5 and CK6 have the same waveform, and clock signals CK7 and CK8 have the same waveform. The waveforms of clock signals CK1 or CK2 differ from those of clock signals CK3 or CK4 by one time period, the waveforms of clock signals CK3 or CK4 differ from those of clock signals CK1 or CK2 by one time period, and those of clock signals CK5 or CK6 differ from those of clock signals CK7 or CK8 by one time period. The scanning lines 1 on the panel can be opened line by line from the first row and the second row at a time.

Further, the waveforms of the frame start signals input from input terminals of the frame start signals STV are identical of the two shift register units in the shift register group. The frame start signals STV input from the two shift register units 4 in the shift register group are the output signals of the previous two shift register units 4, and the output signals of the previous two shift register units 4 have the same waveforms. The waveforms of the frame start signals STV input from the two shift register units 4 in the group are identical. The waveforms of the frame start signals STV of the third shift register unit 4 and the fourth shift register unit 4 are shown in FIG. 2.

Further, the waveforms of the frame start signals input from input terminals of the frame start signals are equal of the two shift register units 4 in the shift register group. As the waveforms of clock signals received by shift register units 4 in the same group are the identical, that is, after shift register units 4 convert clock signals into output signals, the waveforms of output signals of shift register units 4 in the same group are also identical. The waveforms of output signals of the third and fourth shift register units 4 are shown in FIG. 2.

Further, the shift register unit 4 includes a capacitor C, one end of which is connected between the drain end of the first switching tube M1 and the gate end of the third switching tube M3, and the other end of which is connected to the drain end of the third switching tube M3 and the source end of the fourth switching tube M4.

Furthermore, an input end of a reset signal is formed between the gate end of the second switch tube M2 and the gate end of the fourth switch tube M4. In some of the embodiment, except for the first shift register unit 4 which does not input a reset signal, the other shift register units 4 need to input a reset signal. The output signal of the next shift register unit 4 can also be used as the reset signal of the previous shift register unit, which is input to the input end for reset signal of the previous-stage shift register unit 4.

Furthermore, when the input terminal of the reset signal receives the output signal from the next shift register unit 4, the input terminal is at a high level. The second switch tube M2 and the fourth switch tube M4 are "on". Both ends of the capacitor C are connected with a low potential by the input end of the low voltage VSS of DC for discharging.

Figure 4:
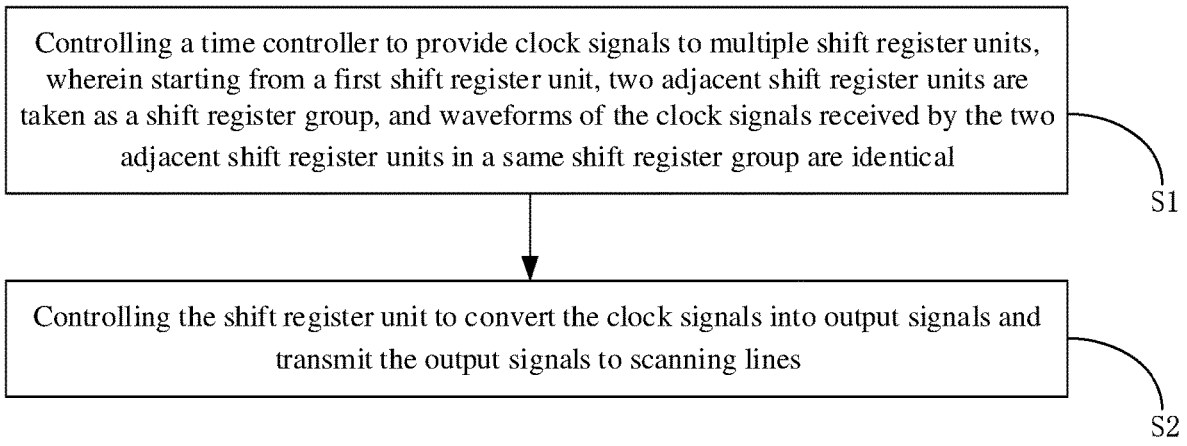
FIG. 4 is a flow chart showing operations of a method of driving a panel according to an embodiment of the present disclosure.
Figure 5:
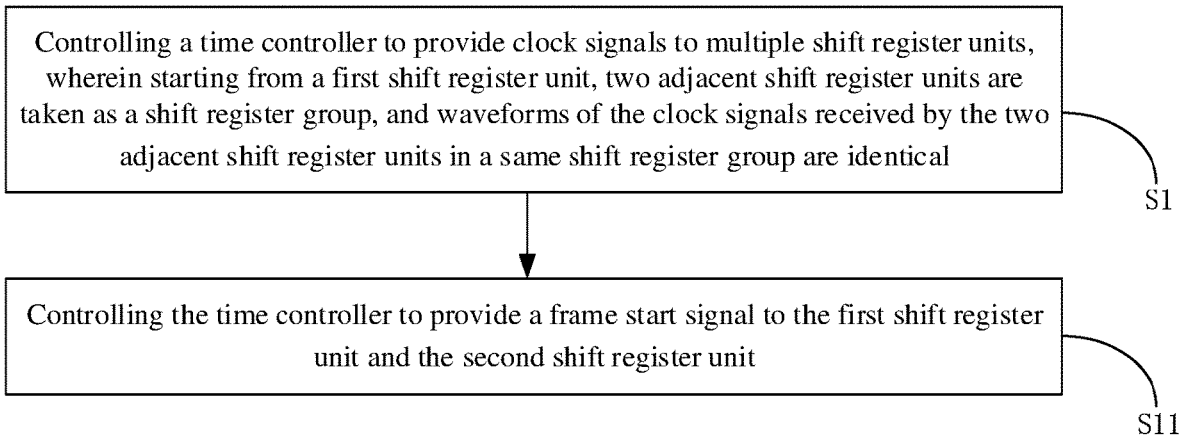
FIG. 5 is a flow chart showing operations of a method of driving the panel according to another embodiment of the present disclosure.

Based on the above embodiments, as shown in FIGS. 4-5, the present disclosure also provides a method of driving the panel.

In an embodiment, as shown in FIG. 4, the method of driving the panel includes:

Operation S1, controlling a time controller to provide clock signals to multiple shift register units, starting from a first shift register unit, two adjacent shift register units are taken as a shift register group, and waveforms of the clock signals received by the two adjacent shift register units in a same shift register group are equal.

Operation S2, controlling the shift register units to convert the clock signals into output signals and transmit the output signals to scanning lines.

In an embodiment, the control time controller 3 provides clock signals to the multiple shift register units 4. As shown in FIGS. 1 to 3, the time controller 3 is connected to ends of the clock signal connecting line 2, and the input ends of the shift register units 4 are correspondingly connected to the other ends of the clock signal connecting line 2 to receive the clock signals of the time controller 3. The output ends of the shift register units are connected with the scanning lines in one-to-one correspondence. The time controller 3 correspondingly inputs clock signals CK1 to CKN to the clock signal connection lines 2, where n is the number of clock signal connection lines 2. In one embodiment, n is any even number ranging from 2 to 12. In the present embodiment, n is 8. That is, the time controller 3 can provide eight clock signals for the multiple shift register units 4. It can be understood that in some other embodiments, n can also be 4, The time controller 3 can provide four clock signals for the multiple shift register units 4. The number of n is not limited herein.

Further, starting from a first shift register unit, two adjacent shift register units 4 are taken as a shift register group, and waveforms of the clock signals sent by the time controller 3 to the two adjacent shift register units 4 are equal via the clock signal connecting lines in a same shift register group.

Further, the shift register units 4 are controlled to convert the clock signals into output signals and transmit them to the scanning lines 1. For example, as shown in FIG. 2, the time controller 3 simultaneously inputs clock signals having the same waveform into the first shift register unit 4 and the second shift register unit 4. The first shift register unit 4 and the second shift register unit 4 convert the clock signals into output signals, and transmit the output signals to drive the two scanning lines 1 connected correspondingly.

Further, the panel includes red, green and blue pixels. Taking charging red pixels as an example, if the clock signals CK1 and CK2 are clock signals with different waveforms, the clock signal CK1 can only drive the corresponding shift register unit 4 and scanning line 1. One clock signal may merely charge the red pixel corresponding to one scanning line 1. And if the clock signals CK1 and CK2 are clock signals with a same waveform, the clock signals CK1 and CK2 can drive the corresponding two shift register units 4 and their corresponding scanning lines 1. A same clock signal (CK1 and CK2) can charge the red pixels corresponding to the two scanning lines 1. As such, two scanning lines 1 can be driven simultaneously by a same clock signal, speeding up the charging of the panel and reducing the resolution.

In an embodiment, as shown in FIG. 5, the method of driving the panel includes:

Operation S11, controlling the time controller to provide a frame start signal to the first shift register unit and the second shift register unit.

In this operation, in order to ensure the normal functionality of the shift register units 4, it is necessary to input the frame start signal STV and the clock signals to the shift register unit 4 to start the shift register units 4, and convert the clock signals into an output signals and transmit them to the scanning lines 1. The shift register unit 4 includes a first switch tube M1, a second switch tube M2, a third switch tube M3 and a fourth switch tube M4. The gate end and source end of the first switching tube M1 are connected to form the input end of the frame start signal STV. The drain end of the first switching tube M1 is connected with the gate end of the third switching tube M3 and the source end of the fourth switching tube M4, respectively. The drain end of the third switch tube M3 is connected with the source of the fourth switch tube M4. The drain end of the second switch tube M2 is connected with the drain end of the fourth switch tube M4 to form the input end of low voltage VSS of DC. The source of the third switch tube M3 is connected with the clock signal connecting line 2. An output end of the output signal G(n) is formed between the drain end of the third switching tube M3 and the source end of the fourth switching tube M4.

Furthermore, when the frame start signal STV of the shift register unit 4 is not input to the input end of the frame start signal STV, and the time controller 3 inputs a clock signal to the source end of the third switch tube M3 through the clock signal connection line 2, the gate of the third switch tube M3 is still at a low level, that is, the third switch tube M3 would be in a closed state, the drain end and source end of the third switch tube M3 would be turned off, so that the output terminal of the output signal outputs a low level. Or, when the frame start signal STV of the shift register unit 4 is input to the input end of the frame start signal STV, and no clock signal is input to the source end of the third switch tube M3, the first switch tube M1 is on, that is, the gate of the third switch tube M3 would be still at a high level. The source end of the third switch tube M3 is at a low level, the drain end and source end of the third switch tube M3 are still off, so that the output end of the output signal outputs a low level.

Further, when the frame start signal STV of the shift register unit 4 is input to the input end of the frame start signal STV, and the time controller 3 inputs a clock signal to the source end of the third switch tube M3 through the clock signal connection line 2, the first switch tube M1 would be in an "on" state. That is, the gate of the third switch tube M3 is still in a high level. That is, the third switch tube M3 is in a "off" state, and the source end of the third switch tube M3 is at high level, the drain end and source end of the third switch tube M3 are conducted. The output signal from the output end is at high level. That is, the first shift register unit 4 and the second shift register unit 4, are provided by the time controller 3 with the frame start signal STV.

Furthermore, except for the first stage shift register unit 4 and the second stage shift register unit 4, the frame start signal STV of the odd-numbered shift register unit 4 is the output signal of the previous odd-numbered stage shift register unit 4, and the frame start signal STV of the even-numbered shift register unit 4 is the output signal of the previous even-numbered shift register unit 4. For example, the frame start signal STV of the fifth shift register unit 4 is the output signal of the third stage shift register unit 4, and the frame start signal STV of the sixth shift register unit 4 is the output signal of the fourth shift register unit 4. That is to say, the output signal of the shift register unit 4 is not only configured to drive the scanning line 1 connected thereto, but also configured as the frame start signal STV of the next corresponding shift register unit 4 for its start.

In the embodiment of the present disclosure, the method of driving the panel comprises the following steps: controlling a time controller to provide clock signals to multiple shift register units, wherein starting from a first shift register unit, two adjacent shift register units are taken as a shift register group, and waveforms of the clock signals received by the two adjacent shift register units in a same shift register group are identical; and controlling the shift register units to convert the clock signals into an output signals and transmit them to the scanning lines. As such, two scanning lines can be driven simultaneously by a same clock signal, speeding up the charging of the panel and reducing the resolution.

Based on the above embodiments, the present disclosure also provides a display device, which comprises an array substrate, an opposite substrate arranged opposite to the array substrate and a liquid crystal cell layer arranged between the array substrate and the opposite substrate; The array substrate includes the circuit as described in the above embodiments.

Since the display device includes the circuit in the above embodiments, that is, the display device in this embodiment has all the technical features and effects of the circuit in the above embodiment, specific reference is made to the description of the above embodiment, which is not repeated herein.

The above is only the preferred embodiment of the present disclosure and is not therefore limiting the scope of the present disclosure. Any equivalent modification made by using the contents of the present specification and drawings, or directly or indirectly applied in other related technical fields, shall be included in the protection scope of the present disclosure.

What is claimed is:

1. A circuit of driving a panel, comprising:

a plurality of scanning lines;

a plurality of clock signal connecting lines;

a time controller connected with ends of the clock signal connecting lines, and multiple shift register units arranged in cascade, wherein input ends of the shift register units are correspondingly connected to other ends of the clock signal connecting lines to receive clock signals sent by the time controller, and output ends of the shift register units are connected with the scanning lines in one-to-one correspondence, wherein, starting from a first shift register unit, two adjacent shift register units are taken as a shift register group, and waveforms of two clock signals sent by the time controller to the two adjacent shift register units in a same shift register group are equal via the clock signal connecting lines; two scanning lines in the same shift register group are driven simultaneously by the two clock signals having the equal waveforms; and a wave of a clock signal received by a first shift register group is earlier than a wave of a clock signal received by a second shift register group just following the first shift register group by one periodic time, shift register groups on the panel are opened one by one at a time;

wherein each of the multiple shift register units comprises a first switch tube, a second switch tube, a third switch tube and a fourth switch tube, a gate end of the first switch tube is connected with a source end of the first switch tube to form an input end of a frame start signal, and a drain end of the first switch tube is connected with a gate end of the third switch tube and a source end of the second switch tube, respectively, a drain end of the third switch tube is connected with a gate end of the fourth switch tube, a drain end of the second switch tube is connected with a drain end of the fourth switch tube to form an input end of a low voltage of DC, a source end of the third switch tube is connected with the clock signal connecting lines, wherein an output end for an output signal is formed between the drain of the third switch tube and the source of the fourth switch tube; and waveforms of the frame start signals input from input terminals of the frame start signals of the two shift register units in the shift register group are identical.

2. The circuit according to claim 1, wherein waveforms of the output signals by the output terminals of the two shift register units in the shift register group are identical.

3. A method of driving a panel, comprising:

controlling a time controller connected with a plurality of clock signal connecting lines to provide clock signals to multiple shift register units arranged in cascade via the clock signal connecting lines, wherein output ends of the shift register units are connected with a plurality of scanning lines in one-to-one correspondence, starting from a first shift register unit, taking two adjacent shift register units as a shift register group, wherein waveforms of two clock signals received by the two adjacent shift register units in a same shift register group are identical; two scanning lines in the same shift register group are driven simultaneously by the two clock signals having the equal waveforms; and a wave of a clock signal received by a first shift register group is earlier than a wave of a clock signal received by a second shift register group just following the first shift register group by one periodic time, shift register groups on the panel are opened one by one at a time; and controlling the shift register units to convert the clock signals into output signals and transmit the output signals to the scanning lines;

the shift register unit comprises a first switch tube, a second switch tube, a third switch tube and a fourth switch tube, a gate end of the first switch tube is connected with a source end of the first switch tube to form an input end of a frame start signal, and a drain end of the first switch tube is connected with a gate end of the third switch tube and a source end of the second switch tube, respectively, a drain end of the third switch tube is connected with a gate end of the fourth switch tube, a drain end of the second switch tube is connected with a drain end of the fourth switch tube to form an input end of a low voltage of DC, a source end of the third switch tube is connected with the clock signal connecting lines, wherein an output end for an output signal is formed between the drain of the third switch tube and the source of the fourth switch tube; and waveforms of the frame start signals input from input terminals of the frame start signals are identical of the two shift register units in the shift register group.

4. The method according to claim 3, wherein waveforms of the output signals by the output terminals are identical of the two shift register units in the shift register group.

5. A display device, comprising an array substrate, an opposite substrate arranged opposite to the array substrate, and a liquid crystal cell layer arranged between the array substrate and the opposite substrate, wherein the array substrate comprises a circuit comprising:

a plurality of scanning lines;

a plurality of clock signal connecting lines;

a time controller connected with ends of the clock signal connecting lines, and multiple shift register units arranged in cascade, wherein input ends of the shift register units are correspondingly connected to other ends of the clock signal connecting lines to receive clock signals sent by the time controller, and output ends of the shift register units are connected with the scanning lines in one-to-one correspondence, wherein, starting from a first shift register unit, two adjacent shift register units are taken as a shift register group, and waveforms of two clock signals sent by the time controller to the two adjacent shift register units in a same shift register group are equal via the clock signal connecting lines; two scanning lines in the same shift register group are driven simultaneously by the two clock signals having the equal waveforms; and a wave of a clock signal received by a first shift register group is earlier than a wave of a clock signal received by a second shift register group just following the first shift register group by one periodic time, shift register groups on the panel are opened one by one at a time;

the shift register unit comprises a first switch tube, a second switch tube, a third switch tube and a fourth switch tube, a gate end of the first switch tube is connected with a source end of the first switch tube to form an input end of a frame start signal, and a drain end of the first switch tube is connected with a gate end of the third switch tube and a source end of the second switch tube, respectively, a drain end of the third switch tube is connected with a gate end of the fourth switch tube, a drain end of the second switch tube is connected with a drain end of the fourth switch tube to form an input end of a low voltage of DC, a source end of the third switch tube is connected with the clock signal connecting lines, wherein an output end for an output signal is formed between the drain of the third switch tube and the source of the fourth switch tube; and waveforms of the frame start signals input from input terminals of the frame start signals are identical of the two shift register units in the shift register group.

6. The display device according to claim 5, wherein waveforms of the output signals by the output terminals are identical of the two shift register units in the shift register group.

* * * * *